US011524198B2

(12) United States Patent
Hsu

(10) Patent No.: US 11,524,198 B2
(45) Date of Patent: Dec. 13, 2022

(54) EXERCISE MACHINE AND MAGNETIC RESISTANCE AND BRAKE CONTROL STRUCTURE THEREOF

(71) Applicant: GREAT FITNESS INDUSTRIAL CO., LTD., Tainan (TW)

(72) Inventor: Chih-Yung Hsu, Tainan (TW)

(73) Assignee: Great Fitness Industrial Co., Ltd., Tainan (TW)

( * ) Notice: Subject to any disclaimer, the term of this patent is extended or adjusted under 35 U.S.C. 154(b) by 59 days.

(21) Appl. No.: 17/240,227

(22) Filed: Apr. 26, 2021

(65) Prior Publication Data

US 2021/0346747 A1 Nov. 11, 2021

(30) Foreign Application Priority Data

May 7, 2020 (TW) ..... 109205522

(51) Int. Cl.
*A63B 21/005* (2006.01)
*A63B 21/00* (2006.01)
*A63B 21/22* (2006.01)

(52) U.S. Cl.
CPC .... *A63B 21/0056* (2013.01); *A63B 21/00072* (2013.01); *A63B 21/225* (2013.01)

(58) Field of Classification Search
CPC ..... A63B 21/0056; A63B 21/00072; A63B 21/225; A63B 21/0051; A63B 21/012; A63B 21/015; A63B 22/0605
See application file for complete search history.

(56) References Cited

U.S. PATENT DOCUMENTS

2010/0234185 A1* 9/2010 Watt ..... A63B 22/0605 482/8
2016/0096070 A1* 4/2016 Wu ..... A63B 24/0062 482/8
2017/0036053 A1* 2/2017 Smith ..... A63B 21/015
2020/0121981 A1* 4/2020 Wu ..... A63B 21/00069

FOREIGN PATENT DOCUMENTS

EP 3067099 A1 * 9/2016 ..... A63B 21/00069
EP 3278845 A1 * 2/2018 ..... A63B 21/00069

* cited by examiner

*Primary Examiner* — Erin Deery
*Assistant Examiner* — Peter H Forstner
(74) *Attorney, Agent, or Firm* — Rosenberg, Klein & Lee

(57) ABSTRACT

A magnetic resistance and brake control structure includes a sleeve, a rotating member, a compound operating member, a movable shaft, and a cable. The rotating member is coaxially disposed in the sleeve in an axial direction, and is rotatable relative to the sleeve. The rotating member has an axial guide groove extending in the axial direction. The rotating member includes an exposed portion extending out of the sleeve. The compound operating member passes through the rotating member coaxially, and is movable relative to the rotating member in the axial direction. The movable shaft is connected to an operating lever, and is movable along the axial guide groove or drives the rotating member to rotate synchronously through the axial guide groove. The cable has a first end that is directly or indirectly fixed to the exposed portion.

18 Claims, 19 Drawing Sheets

EXERCISE MACHINE AND MAGNETIC RESISTANCE AND BRAKE CONTROL STRUCTURE THEREOF

FIELD OF THE INVENTION

The present invention relates to an exercise machine and a magnetic resistance and brake control structure thereof. An operating lever is movable in a sleeve to extend out of an acting end to abut against a brake unit for braking, or the operating lever is pivoted to drive a positioning member to pivot by an angle to be positioned for controlling a magnetic resistance.

BACKGROUND OF THE INVENTION

Nowadays, sports are becoming more and more popular, not limited to outdoor sports. In general, indoor exercise machines include treadmills, fitness machines, elliptical machines, etc. These exercise machines have a resistance unit to increase the exercise intensity and a brake unit to stop operating. Such two control devices will increase the production cost, and the production is also labor-consuming.

Taiwan Patent Publication No. 1669141 discloses a spinning bike with an integrated brake and resistance adjustment mechanism, comprising a frame, a transmission wheel, a flywheel, and a resistance brake device. The transmission wheel is arranged on the frame. The flywheel may be made of a metal material and is driven to rotate by the transmission wheel. The resistance brake device includes a magnet assembly, a resistance adjustment seat, a control member, a manual brake assembly, and a resistance control assembly. The resistance adjustment seat is connected to the frame. The magnet assembly is pivotally connected to the resistance adjustment seat. The control member is connected to the magnet assembly. The manual brake assembly is installed on the handlebar of the frame, and includes a brake handle and a brake control line. The resistance control assembly includes a motor, a control interface, and a resistance control winding.

The above-mentioned exercise machines or the spinning bike disclosed Taiwan Patent Publication No. 1669141 include a resistance unit and a brake unit that are controlled by two control devices, respectively. Because it includes two control devices, the production cost is increased, the production is more labor-consuming, and the use is less convenient.

SUMMARY OF THE INVENTION

The primary object of the present invention is to provide an exercise machine and a magnetic resistance and brake control structure thereof. An operating lever is movable in a sleeve to extend out of an acting end to abut against a brake unit for braking, or the operating lever is pivoted to drive a positioning member to pivot by an angle to be positioned for controlling a magnetic resistance.

According to one aspect of the present invention, a magnetic resistance and brake control structure is provided. The magnetic resistance and brake control structure comprises a sleeve, a rotating member, a compound operating member, a movable shaft, and a cable. The sleeve has an operating end and an acting end. A rotating member is coaxially disposed in the sleeve in an axial direction. The rotating member is rotatable relative to the sleeve. The rotating member has an axial guide groove extending in the axial direction. The rotating member includes an exposed portion extending out of the acting end. The compound operating member includes an operating portion and an operating lever. The operating portion is exposed at the operating end. The operating lever passes through the rotating member coaxially. The operating lever has a pressing end extending out of the exposed portion. The operating lever is movable relative to the rotating member in the axial direction. The movable shaft is connected to the operating lever. The movable shaft is movable along the axial guide groove or drives the rotating member to rotate synchronously through the axial guide groove. The cable has a first end that is directly or indirectly fixed to the exposed portion. When the operating portion is rotated, the movable shaft drives the rotating member to rotate synchronously, so that the exposed portion pulls the cable to be retracted or released around the axial direction. When the operating portion is pressed, the operating lever is moved relative to the exposed portion in the axial direction.

According to another aspect of the present invention, an exercise machine having a magnetic resistance and brake control structure is provided. The exercise machine further comprises a frame, a flywheel, a brake unit, a magnetic resistance unit, and the foregoing magnetic resistance and brake control structure. The flywheel is rotatably connected to the frame. The brake unit is pivotally connected to the frame. The brake unit is actuated by the pressing end to touch the flywheel for performing a brake or to move away from the flywheel for releasing the brake. The magnetic resistance unit is pivotally connected to the frame. The magnetic resistance unit is connected to a second end of the cable. The magnetic resistance unit is controlled by the cable to move toward the flywheel or to move away from the flywheel, so as to control a magnetic resistance of the flywheel.

Preferably, the rotating member further includes a body portion. One end of the body portion has a flange extending in a radial direction perpendicular to the axial direction. When the rotating member is disposed in the sleeve, the flange abuts against the operating end. Another end of the body portion is connected to the exposed portion. A stepped face is formed between the body portion and the exposed portion. The rotating member has an axial hole passing through the body portion and the exposed portion in the axial direction. The axial guide groove is disposed on the body portion. The operating lever passes through the axial hole.

Preferably, the movable shaft includes a shaft body and a protrusion. The shaft body has a through hole extending in the axial direction. The operating lever passes through the through hole, so that the shaft body is assembled in the axial hole, and the protrusion is slidable in the axial guide groove.

Preferably, the magnetic resistance and brake control structure further comprises a positioning member. The positioning member is located in the sleeve. The positioning member abuts against the stepped face. The positioning member has a perforation extending in the axial direction. The exposed portion passes through the perforation to be fixed to the positioning member.

Preferably, the magnetic resistance and brake control structure further comprises a cable reel. The cable reel has a cable groove formed on a periphery of the cable reel. The first end of the cable is connected to the cable reel, and the cable is received in the cable groove. The cable reel is fixed to the exposed portion and abuts against the acting end of the sleeve. The rotating member is restricted by the cable reel and the positioning member so that the rotating member cannot move in the axial direction.

Preferably, the magnetic resistance and brake control structure further comprises a limit disk fixed to the exposed portion. The limit disk includes a protruding block extending in the radial direction. When the rotating member is driven to rotate by the movable shaft, the cable reel and the limit disk are synchronously driven to rotate along a rotation path. The rotation path is provided with a limit member corresponding to the protruding block. The limit member is configured to abut against the protruding block for limiting a rotation angle of the cable reel.

Preferably, an outer circumference of the positioning member is formed with a plurality of positioning grooves. A stop unit is connected to the sleeve. The stop unit includes an insert and a blocking member. The insert has a blind hole extending in the radial direction. A first spring is provided in the blind hole. The blocking member is disposed at an open end of the blind hole. The blocking member is moved back and forth in the radial direction. The first spring abuts against the blocking member. The blocking member is pressed against any one of the positioning grooves, so that the positioning member and the rotating member are positioned synchronously.

Preferably, the blocking member has a spherical surface configured to abut against any one of the positioning grooves.

Preferably, the brake unit includes a brake seat, a friction block, and a second spring. The brake seat is pivotally connected to the frame. The friction block is fixed to the brake seat and faces the flywheel. One end of the second spring is connected to the frame, and another end of the second spring is connected to the brake seat to exert a return elastic force on the brake seat toward the pressing end.

Preferably, the magnetic resistance unit includes a magnetic resistance seat, at least one magnetic member, and a third spring. The magnetic resistance seat is pivotally connected to the frame via a first pivot point. The magnetic resistance seat includes a first seat end and a second seat end. The first seat end and the second seat end are located on different sides of the first pivot point, respectively. The magnetic member is fixed in the magnetic resistance seat. The magnetic resistance seat has an open slot. The magnetic member is disposed in the open slot. One end of the third spring is connected to the frame, and another end of the third spring is connected to the first seat end. The second end of the cable is connected to the second seat end. The cable controls the magnetic resistance seat to rotate about the first pivot point as an axis, so that the open slot is moved toward the flywheel or away from the flywheel.

According to the above technical features, the following effects can be achieved:

1. The operating lever is movable in the sleeve to extend out of the acting end, so that the pressing end of the operating lever is pressed against the brake seat, and the brake seat generates a braking force. The braking force enables the flywheel to brake quickly or slow down the speed quickly. By pivoting the operating lever to drive the positioning member to pivot by an angle and then be positioned, the magnetic resistance unit can be controlled to generate different magnetic resistances to the flywheel of the exercise machine.

2. In this invention, a rotating member is provided between the sleeve and the operating lever. The operating lever has a movable shaft. The rotating member has an axial guide groove. The movable shaft is connected to the axial guide groove. The length of the operating lever to extend out of the acting end is controlled by the axial guide groove, and the rotating member is rotatable relative to the sleeve through the movable shaft.

DESCRIPTION OF THE PREFERRED EMBODIMENTS

Embodiments of the present invention will now be described, by way of example only, with reference to the accompanying drawings.

Figure 1:
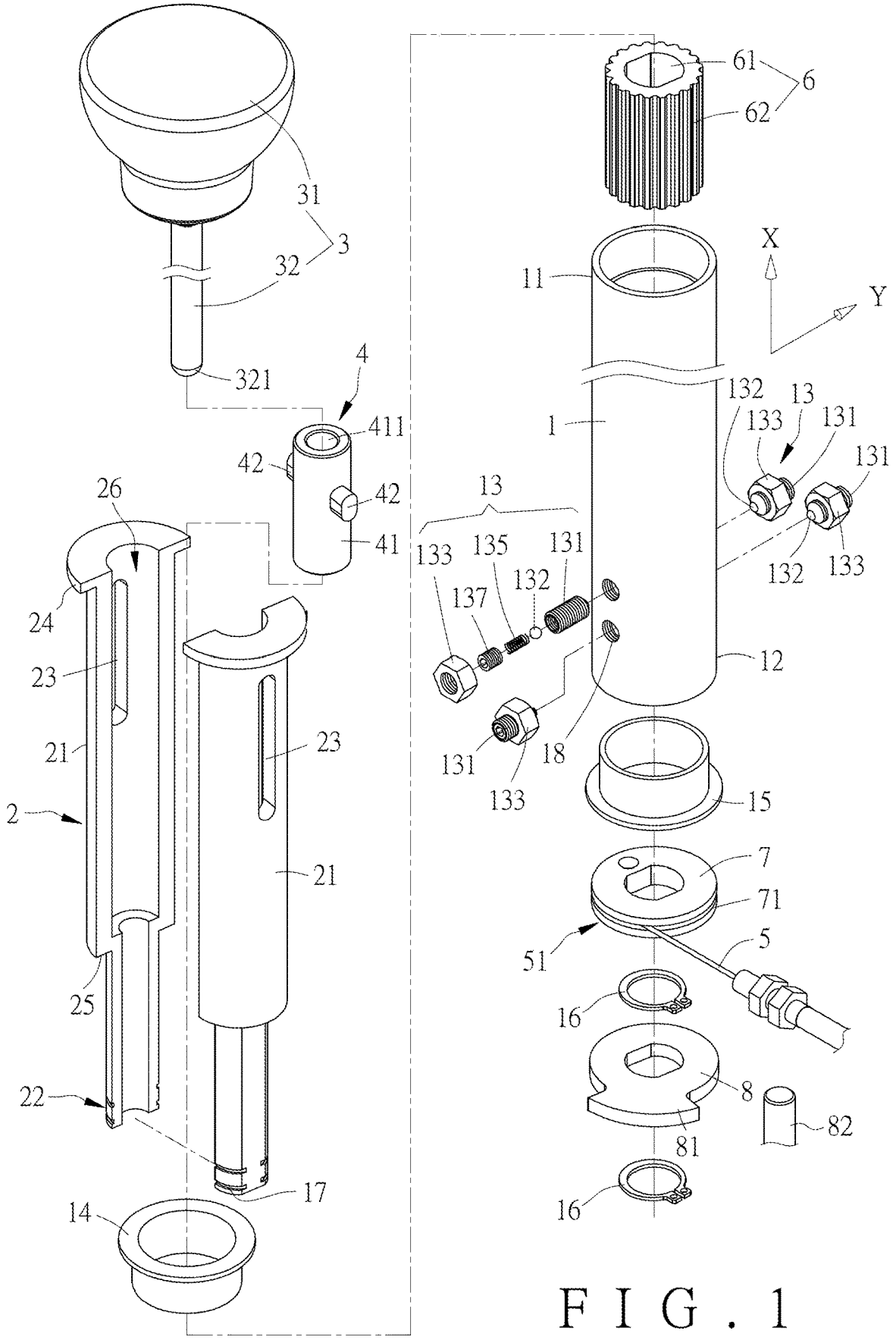
FIG. 1 is an exploded view of the magnetic resistance and brake control structure of the present invention.
Figure 2:
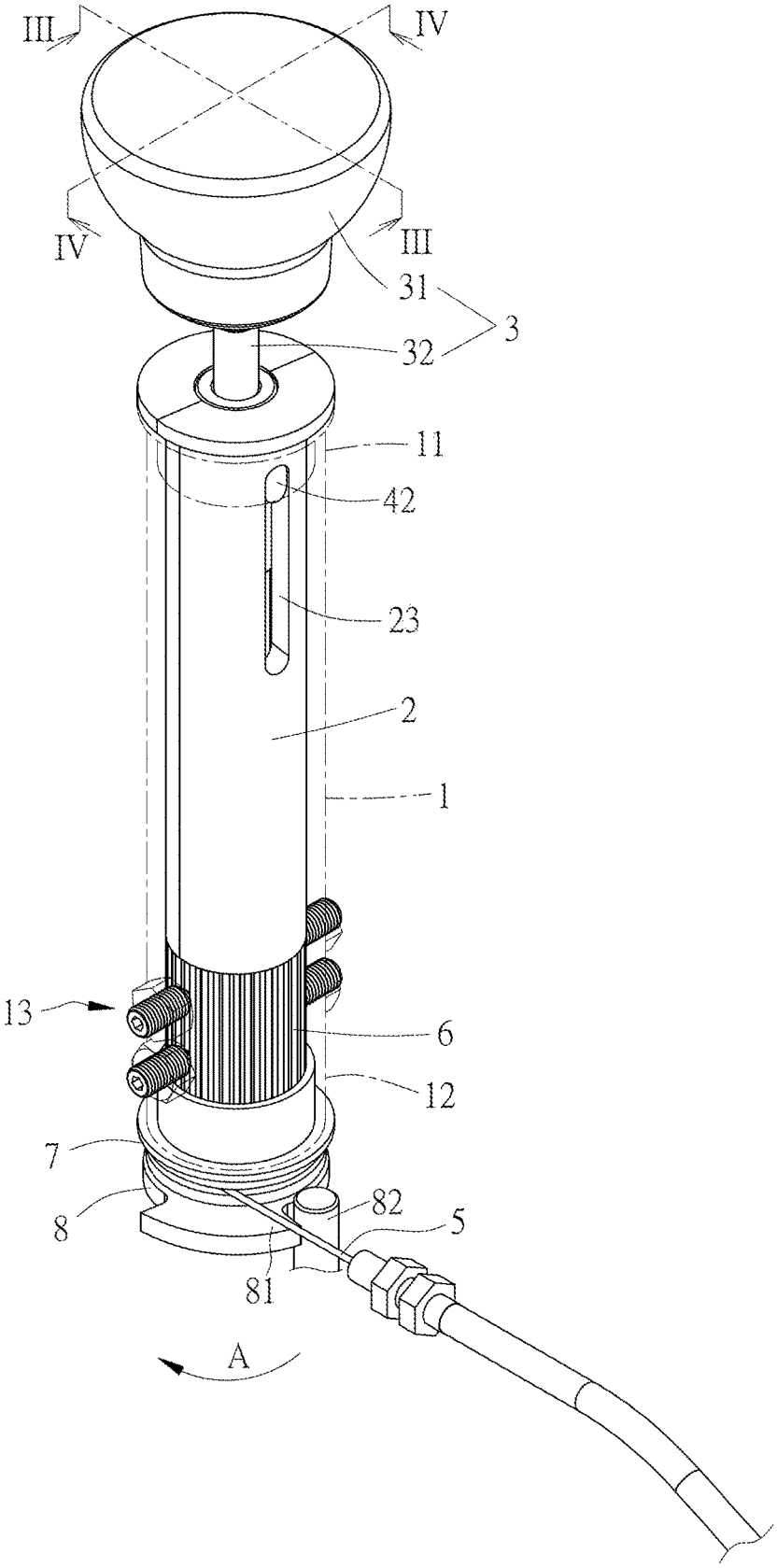
FIG. 2 is a perspective view of the magnetic resistance and brake control structure of the present invention.
Figure 3:
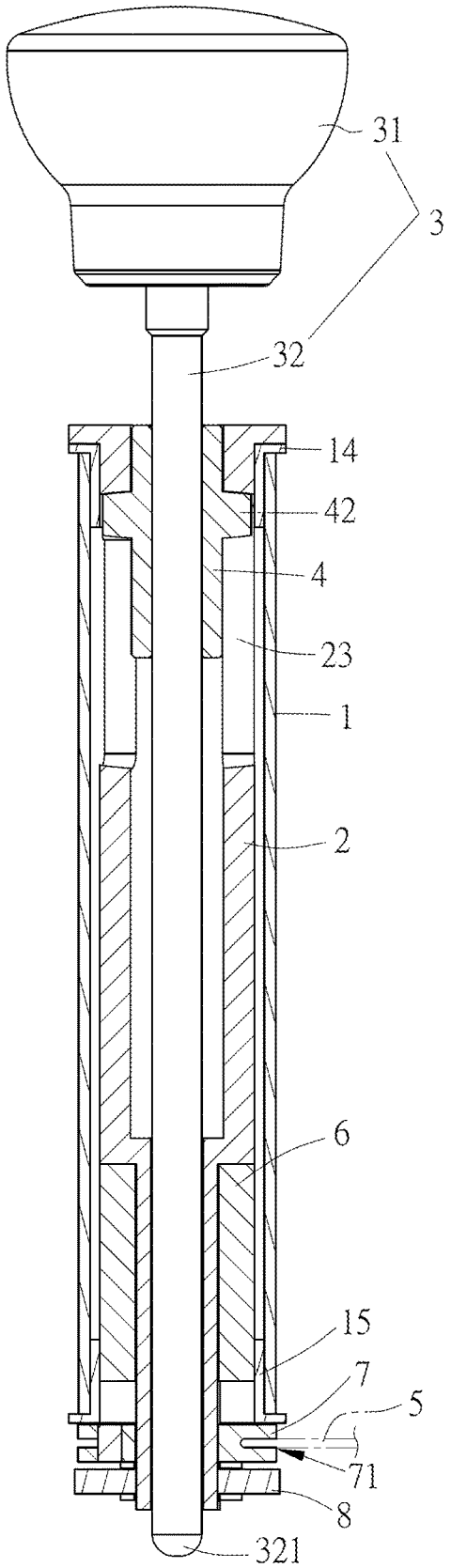
FIG. 3 is a cross-sectional view of the magnetic resistance and brake control structure of the present invention.

As shown in FIG. 1 through FIG. 3, the present invention discloses a magnetic resistance and brake control structure. The magnetic resistance and brake control structure comprises a sleeve 1, a rotating member 2, a compound operating member 3, a movable shaft 4, a cable 5, a positioning member 6, a cable reel 7, and a limit disk 8. The sleeve 1 extends in an axial direction X and has an operating end 11 and an acting end 12. A first bushing 14 and a second bushing 15 are sleeved on the operating end 11 and the acting end 12 of the sleeve 1, respectively. In this embodiment, the rotating member 2 includes two symmetrical semi-cylindrical blocks. The rotating member 2 extends into the sleeve 1 and is coaxially disposed in the sleeve 1 in the axial direction X. The rotating member 2 is rotatable relative to the sleeve 1. The rotating member 2 includes a body portion 21 and an exposed portion 22. The cross-section of the exposed portion 22 is in a non-circular shape. The rotating member 21 has an axial guide groove 23 extending in the axial direction X. The axial guide groove 23 of this embodiment is a slide groove. One end of the body portion 21 has a flange 24 extending in a radial direction Y perpendicular to the axial direction X. When the rotating member 2 is disposed in the sleeve 1, the flange 24 abuts against the first bushing 14 of the operating end 11. The other end of the body portion 21 is connected to the exposed portion 22. The exposed portion 22 extends out of the acting end 12. A stepped face 25 is formed between the body portion 21 and the exposed portion 22. The rotating member 2 has an axial hole 26 passing through the body portion 21 and the exposed portion 22 in the axial direction X. The axial guide groove 23 is disposed on the body portion 21. The compound operating member 3 includes an operating portion 31 and an operating lever 32. The operating portion 31 is exposed at the operating end 11. The operating lever 32 passes through the rotating member 2 coaxially. The operating lever 32 passes through the axial hole 26. The operating lever 32 has a pressing end 321 extending out of the exposed portion 22. The operating lever 32 is movable relative to the rotating member 2 in the axial direction X. The movable shaft 4 is connected to the operating lever 32, so that the operating lever 32 and the movable shaft 4 act synchronously. The movable shaft 4 includes a shaft body 41 and two protrusions 42. The shaft body 41 has a through hole 411 extending in the axial direction X. The operating lever 32 passes through the through hole 411, so that the shaft body 41 is assembled in the axial hole 26, and the protrusions 42 are slidable in the axial guide groove 23. The positioning member 6 is located in the sleeve 1. The positioning member 6 has a non-circular perforation 61 extending in the axial direction X. The exposed portion 22 passes through the perforation 61 to be fixed to the positioning member 6. The positioning member 6 abuts against the stepped face 25. The positioning member 6 is rotated synchronously with the rotating member 2. In this embodiment, the outer circumference of the positioning member 6 is formed with a plurality of positioning grooves 62. A cable groove 71 is formed on the periphery of the cable reel 7. The cable 5 has a first end 51 connected to the cable reel 7, and the cable 5 is received in the cable groove 71. The cable reel 7 is sleeved on the exposed portion 22 and abuts against the second bushing 15 of the acting end 12 of the sleeve 1. A C-shaped retaining ring 16 is engaged in a locking groove 17 of the exposed portion 22 to fix the cable reel 7 to the exposed portion 22. The limit disk 8 is sleeved on the exposed portion 22 and located at the lower edge of the cable reel 7. Another C-shaped retaining ring 16 is engaged in another locking groove 17 of the exposed portion 22 to fix the limit disk 8 to the exposed portion 22. The limit disk 8 includes a protruding block 81 extending in the radial direction Y. When the rotating member 2 is driven to rotate by the movable shaft 4, the cable reel 7 and the limit disk 8 are synchronously driven to rotate along a rotation path A. The rotation path A is provided with a limit member 82 corresponding to the protruding block 81. The limit member 82 is configured to abut against the protruding block 81 for limiting the rotation angle of the cable reel 8.

Figure 4:
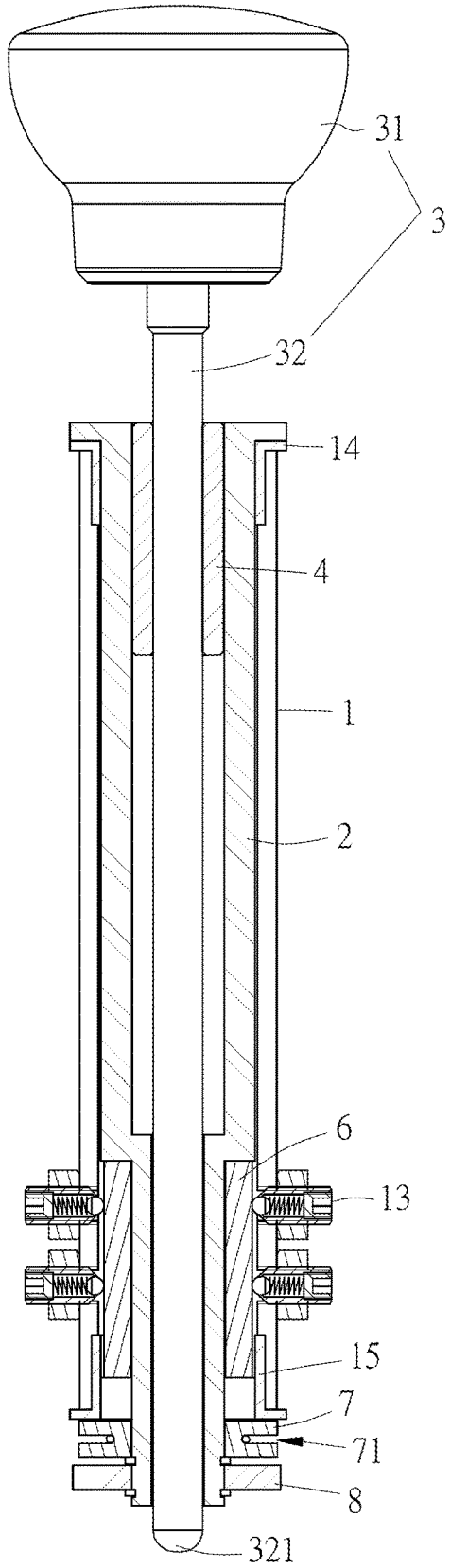
FIG. 4 is another cross-sectional view of the magnetic resistance and brake control structure of the present invention.
Figure 5:
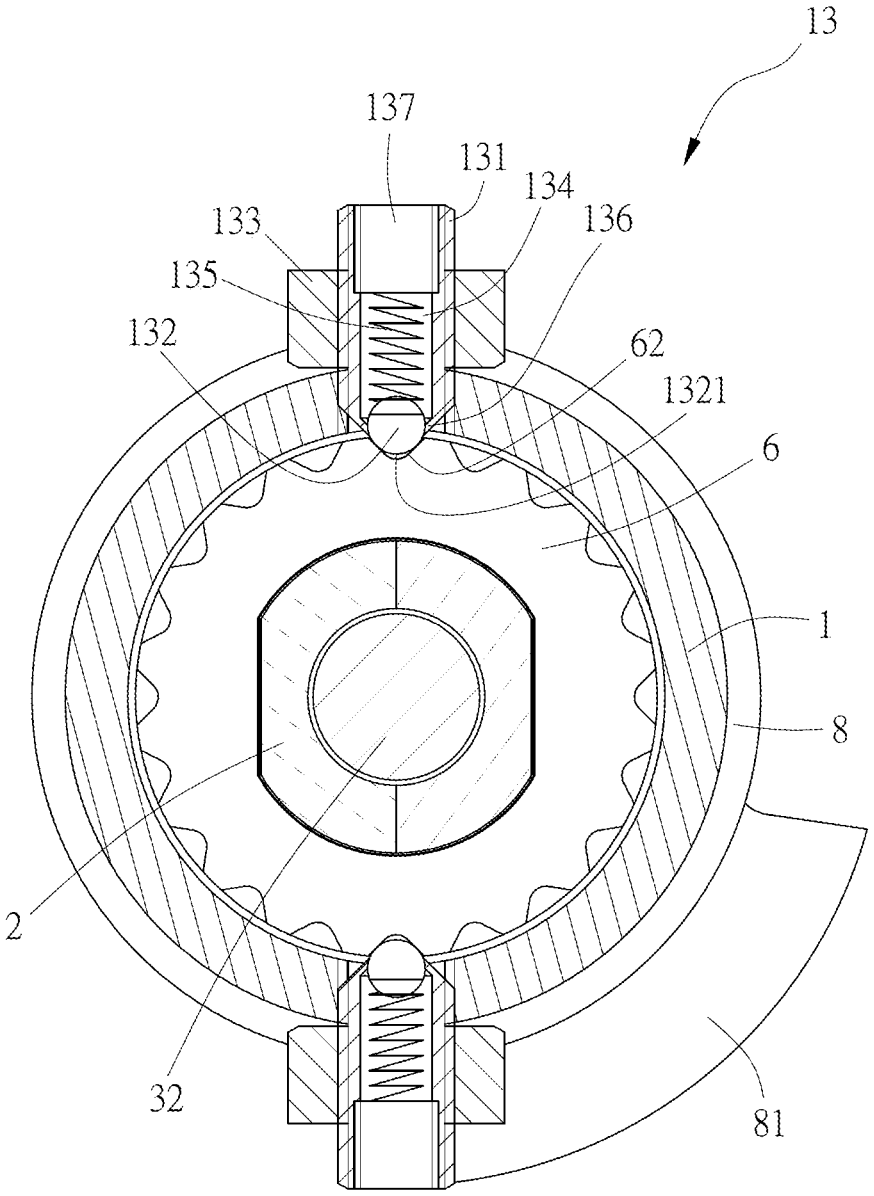
FIG. 5 is a cross-sectional view of the positioning member and the stop unit of the present invention.

Referring to FIG. 1, FIG. 4 and FIG. 5 the sleeve 1 is formed with four orifices 18 extending in the radial direction Y. The orifice 18 is provided with a stop unit 13. The stop unit 13 includes an insert 131, a blocking member 132, a first spring 135, a plug 137, and a fixing member 133. The insert 131 has two hollow ends. The blocking member 132, the first spring 135 and the plug 137 are sequentially inserted into the insert 131 from one end of the insert 131. The blocking member 132 has a spherical surface 1321. The plug 137 closes one end of the insert 131 to form a blind hole 134, so that the other end of the insert 131 becomes an open end 136. The width of the open end 136 is less than the width of the spherical surface 1321, so that the blocking member 132 and the first spring 135 are positioned in the blind hole 134, and the spherical surface 1321 extends out of the open end 136 of the insert 131. The insert 131 passes through the orifice 18, so that the spherical surface 1321 of the blocking member 132 abuts against one of the positioning grooves 62 of the positioning member 6. The fixing member 133 is configured to fix the insert 131 on the sleeve 1.

Figure 6:
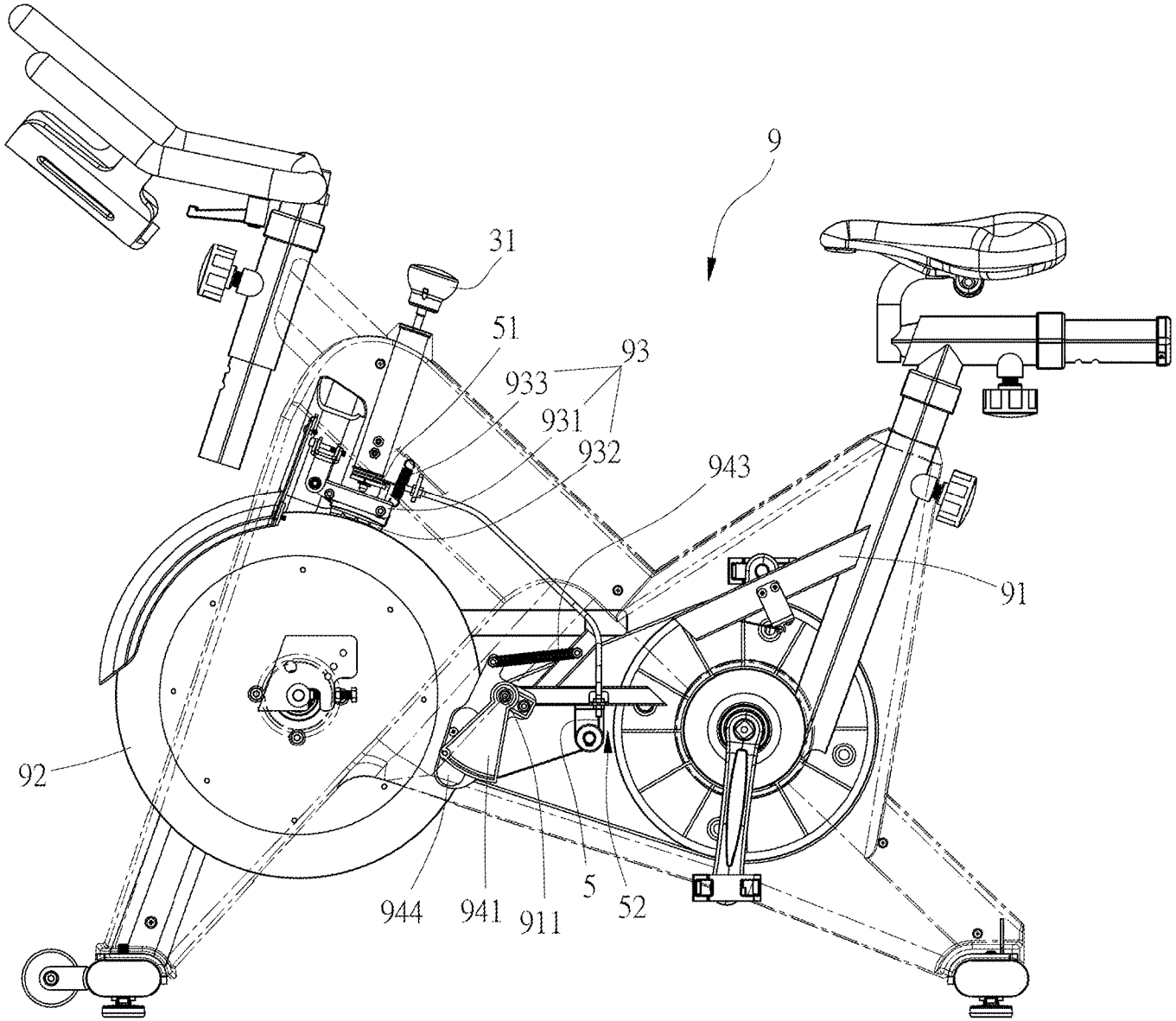
FIG. 6 is a side view of the exercise machine of the present invention.
Figure 7:
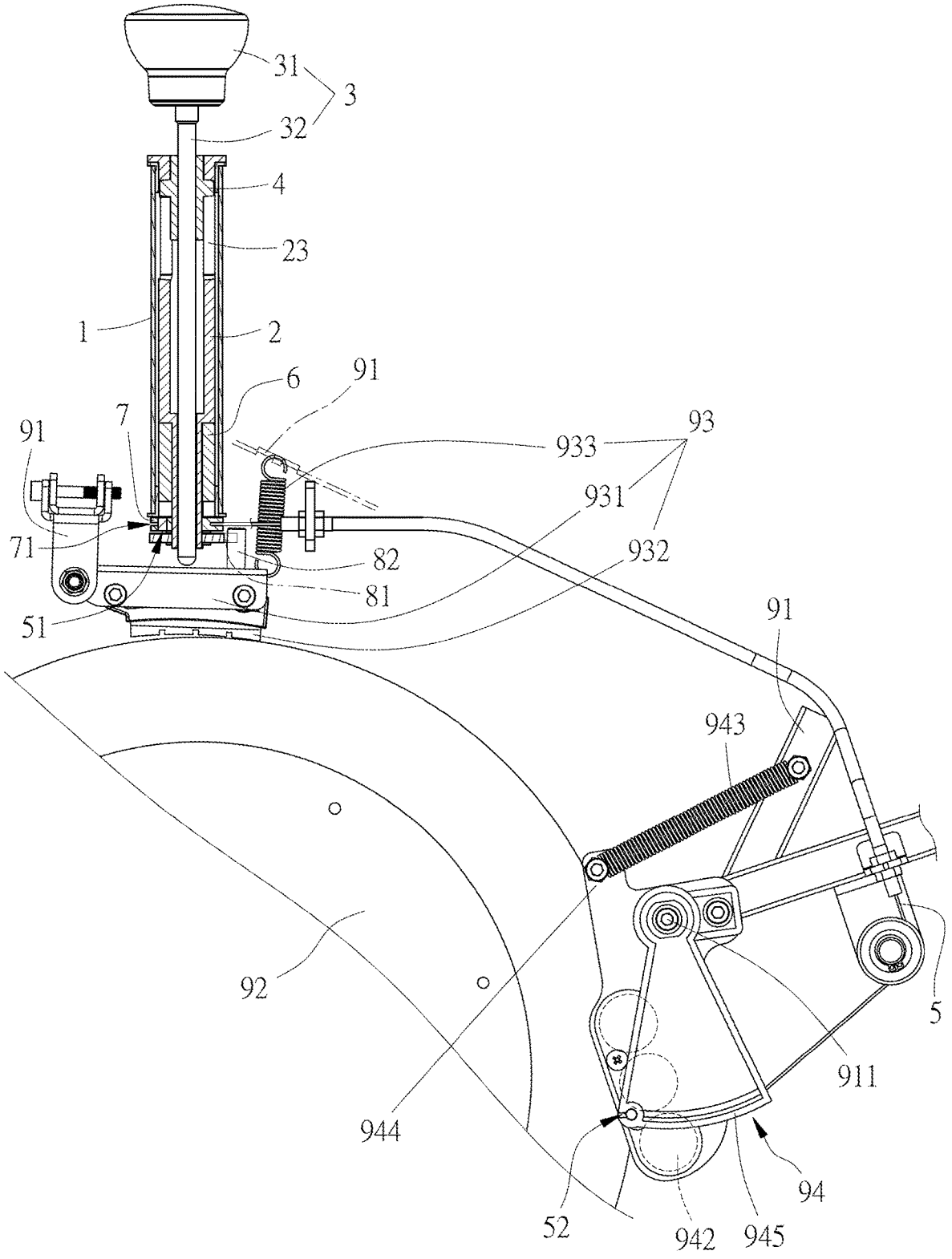
FIG. 7 is a structural view of the brake unit and the magnetic resistance unit of the present invention.
Figure 8:
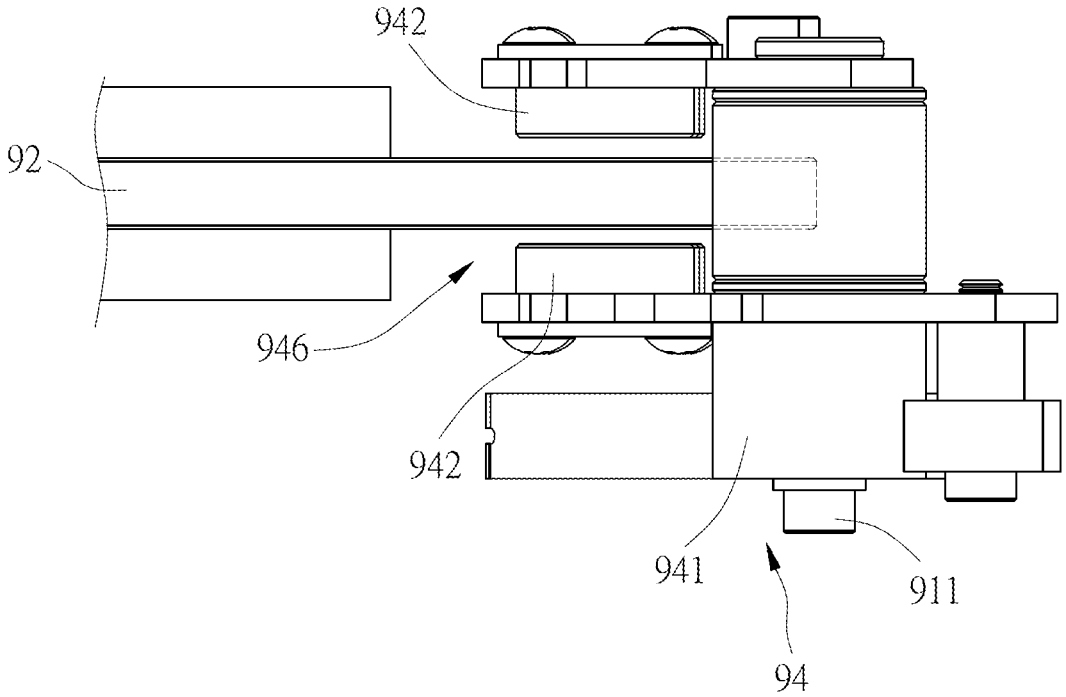
FIG. 8 is a schematic view of the present invention, illustrating that the open slot of the magnetic resistance unit of the present invention is moved close to the flywheel.

Referring to FIG. 6, FIG. 7 and FIG. 8, the present invention further discloses an exercise machine 9. The exercise machine 9 includes the above-mentioned magnetic resistance and brake control structure. The exercise machine 9 of this embodiment is an exercise bike as an example. The exercise machine 9 includes a frame 91, a flywheel 92, a brake unit 93, and a magnetic resistance unit 94. The flywheel 92 of this embodiment is arranged at the front of the exercise machine 9, and the flywheel 92 is pivotally connected to the frame 91. The brake unit 93 is also pivotally connected to the frame 91. The brake unit 93 includes a brake seat 931, a friction block 932, and a second spring 933. The friction block 932 is made of wool felt. The brake seat 931 is pivotally connected to the frame 91. The friction block 932 is fixed to the brake seat 931 and faces the flywheel 92. One end of the second spring 933 is connected to the frame 91, and the other end of the second spring 933 is connected to the brake seat 931. The magnetic resistance unit 94 is pivotally connected to the frame 91. The magnetic resistance unit 94 includes a magnetic resistance seat 941, at least one magnetic member 942, and a third spring 943. The magnetic resistance seat 941 is pivotally connected to the frame 91 via a first pivot point 911. As shown in FIG. 7, the magnetic resistance seat 941 includes a first seat end 944 and a second seat end 945. The first seat end 944 and the second seat end 945 are located on different sides of the first pivot point 911, respectively. As shown in FIG. 8, the magnetic member 942 is fixed in the magnetic resistance seat 941. The magnetic resistance seat 941 has an open slot 946. The magnetic member 942 is disposed in the open slot 946. As shown in FIG. 7, one end of the third spring 943 is connected to the frame 91, and the other end of the third spring 943 is connected to the first seat end 944. A second end 52 of the cable 5 is connected to the second seat end 945. The cable 5 controls the magnetic resistance seat 941 to rotate about the first pivot point 911 as the axis, so that the open slot 946 shown in FIG. 8 is moved toward or away from the flywheel 92.

Figure 9:
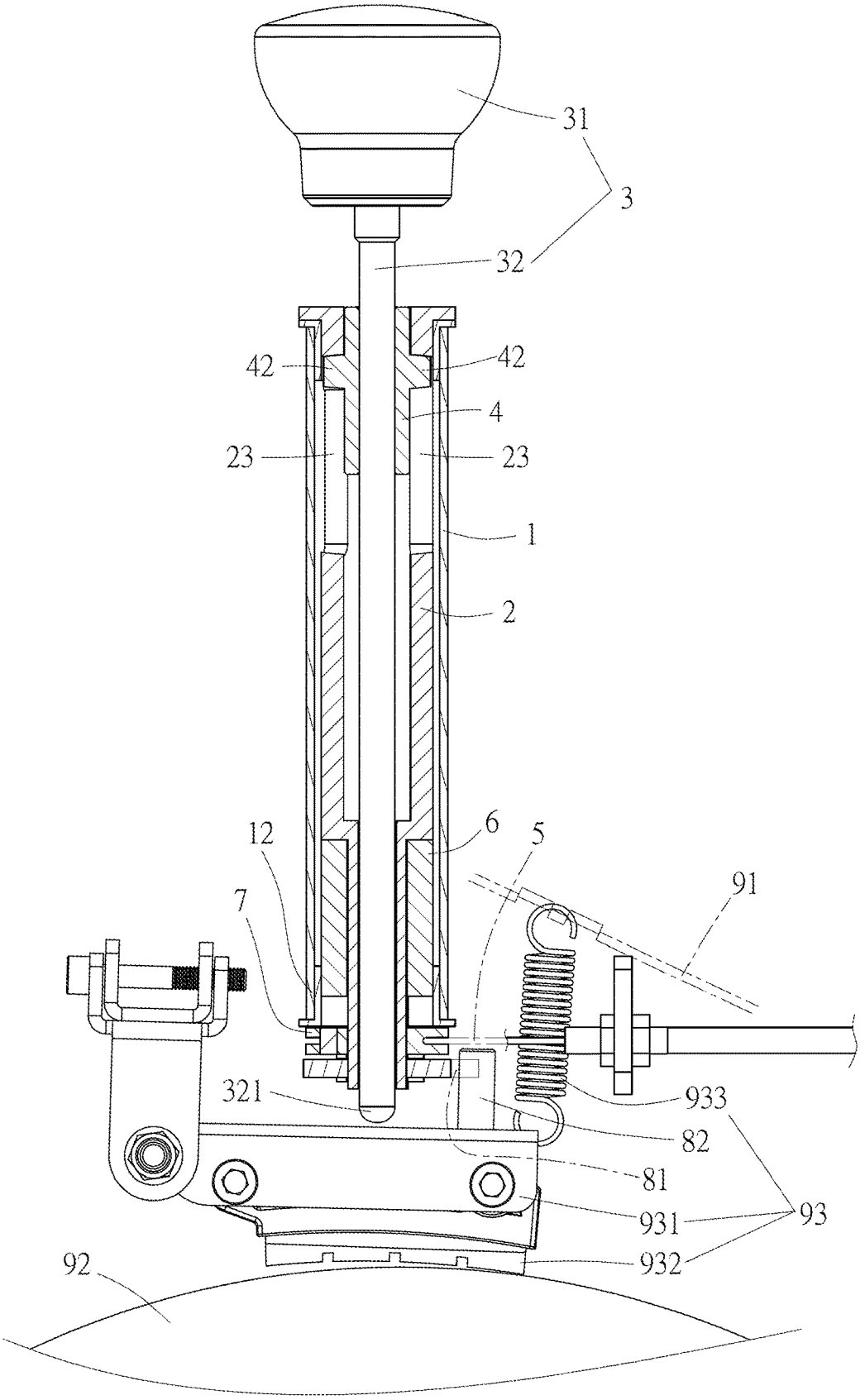
FIG. 9 is a schematic view of the present invention, illustrating that the brake unit is not actuated.
Figure 10:
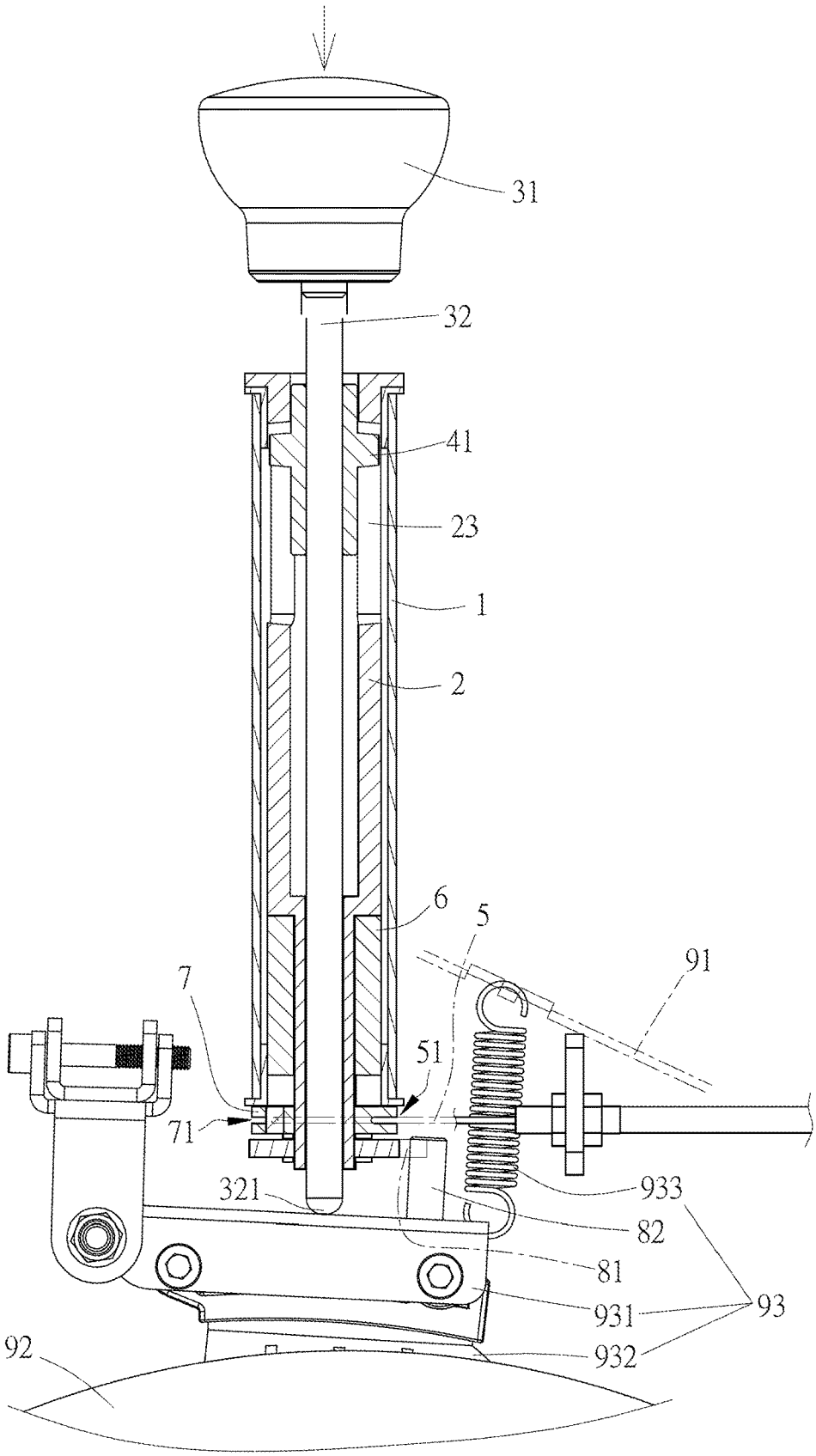
FIG. 10 is a schematic view of the present invention, illustrating that the brake unit is actuated.

As shown in FIG. 9 and FIG. 10, when the exercise machine 9 (as shown in FIG. 6) is used, the user may press the operating portion 31. The operating lever 32 drives the two protrusions 42 of the movable shaft 4 to move axially in the axial guide groove 23 of the rotating member 2, and the axial guide groove 23 restricts the axial displacement distance of the movable shaft 4. Through the above operation, the operating lever 32 is axially moved in the sleeve 1 to extend out of the acting end 12, so that the pressing end 321 of the operating lever 32 is pressed against the brake seat 931. When the brake seat 931 is moved downward, the friction block 932 is pressed against the flywheel 92 to generate a braking force. The second spring 933 is pulled by the brake seat 931. The second spring 933 exerts a return elastic force on the brake seat 931 toward the pressing end 321. The braking force enables the flywheel 92 to brake quickly or slow down the speed quickly. When the user releases the operating portion 31, the brake seat 931 synchronously drives the friction block 932 away from the flywheel 92 through the return elastic force and pushes the pressing end 321 away from the flywheel 92 simultaneously.

Figure 11:
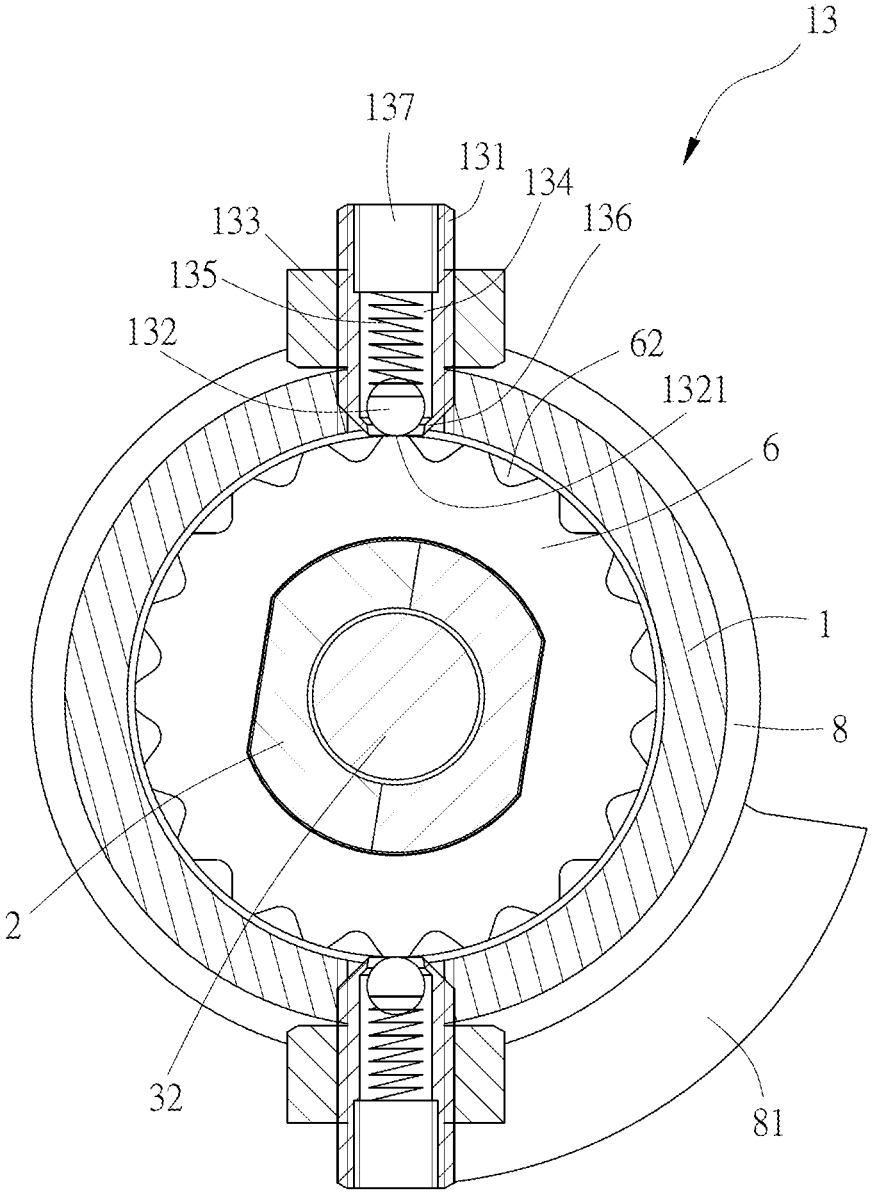
FIG. 11 is a cross-sectional view showing the operation of the positioning member and the stop unit of the present invention.

As shown in FIG. 3, FIG. 4 and FIG. 6, when the user uses the exercise machine 9, the user may rotate the operating portion 31. The operating lever 32 drives the movable shaft 4 to rotate, and the protrusions 42 of the movable shaft 4 drive the rotating member 2 to rotate in the sleeve 1 through the axial guide groove 23. At this time, the rotating member 2 drives the positioning member 6 to rotate. Referring to FIG. 11, the blocking member 132 in the stop unit 13 blocks the first spring 135. When the blocking member 132 extends into the positioning groove 62, the first spring 135 will push the spherical surface 1321 of the blocking member 132 into the positioning groove 62, so that the positioning member 6 is positioned. When the rotating member 2 drives the positioning member 6 to pivot, the blocking member 132 will compress the first spring 135 to move away from the positioning groove 62 to be in the next positioning groove 62.

Figure 12:
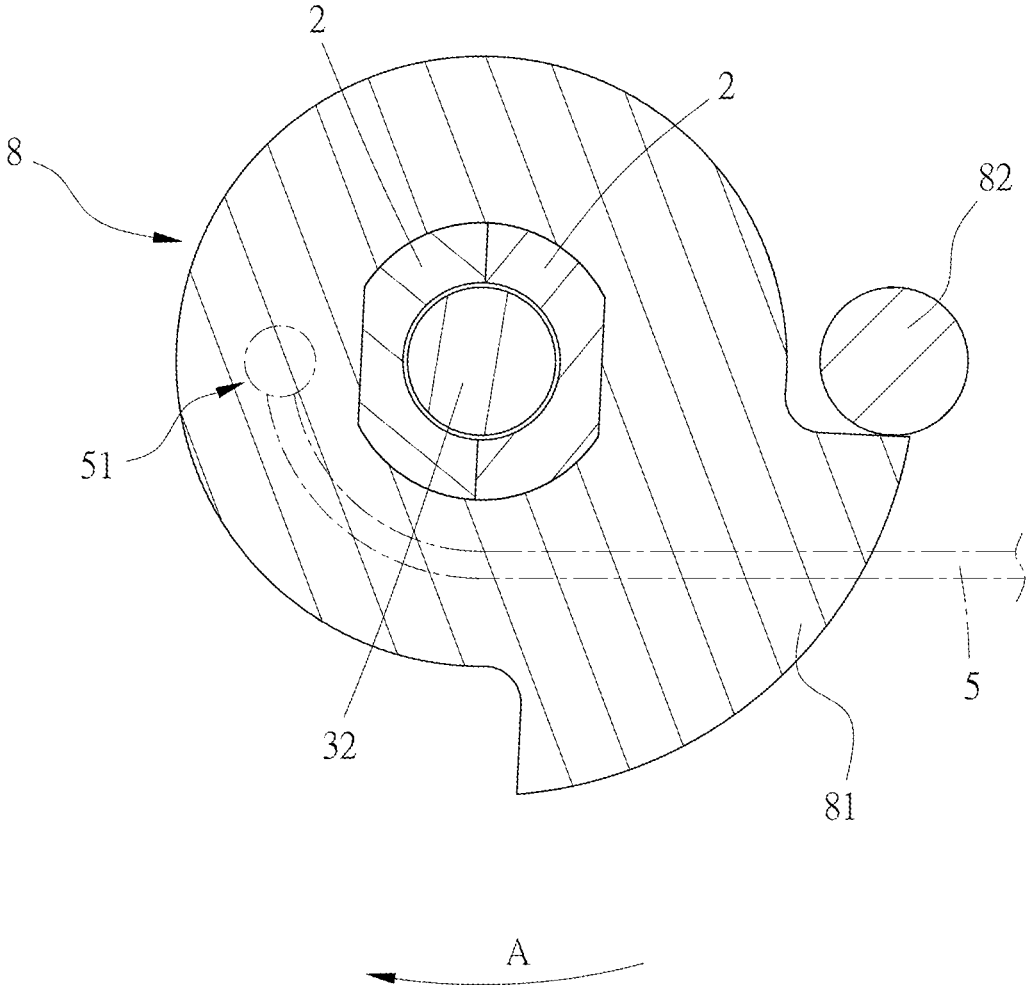
FIG. 12 is a cross-sectional view of the present invention, illustrating that the limit disk is turned to a first position relative to the limit member.
Figure 13:
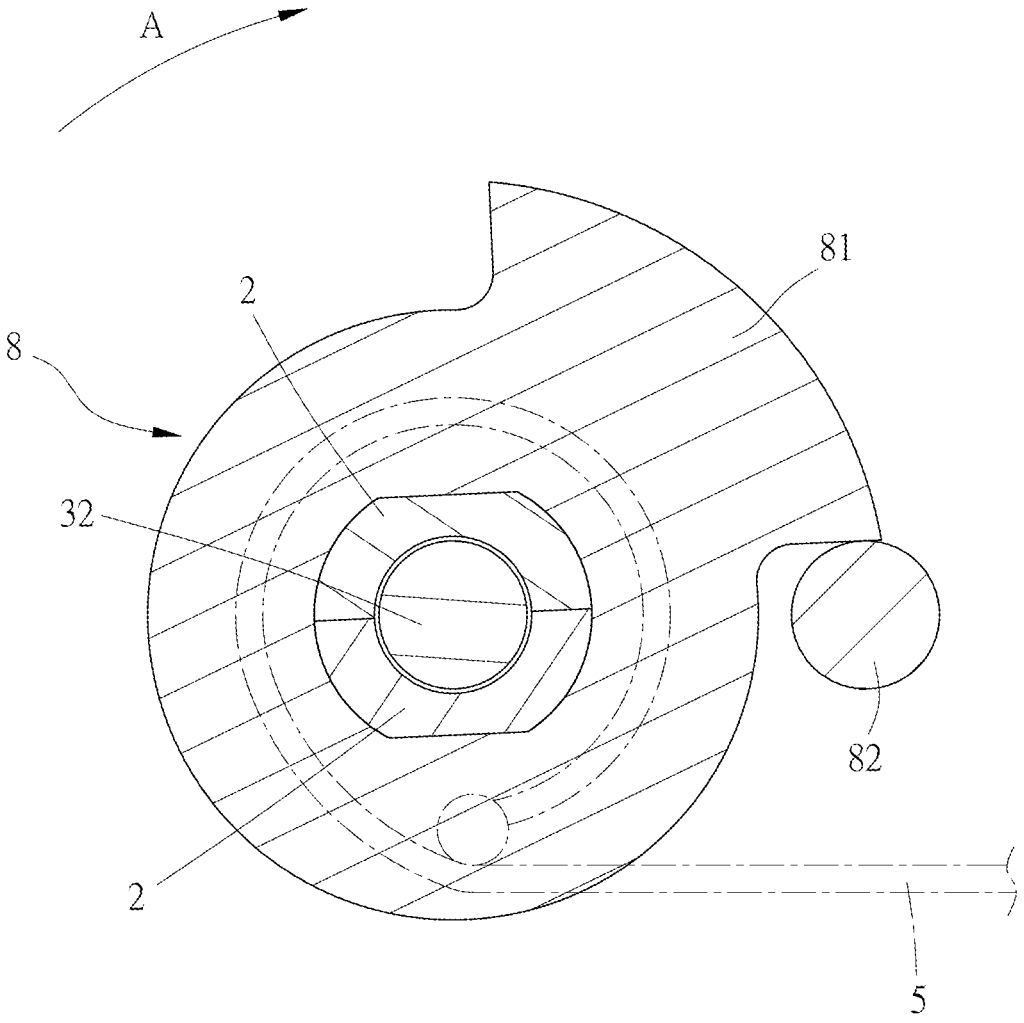
FIG. 13 is a cross-sectional view of the present invention, illustrating that the limit disk is turned to a second position relative to the limit member.
Figure 14:
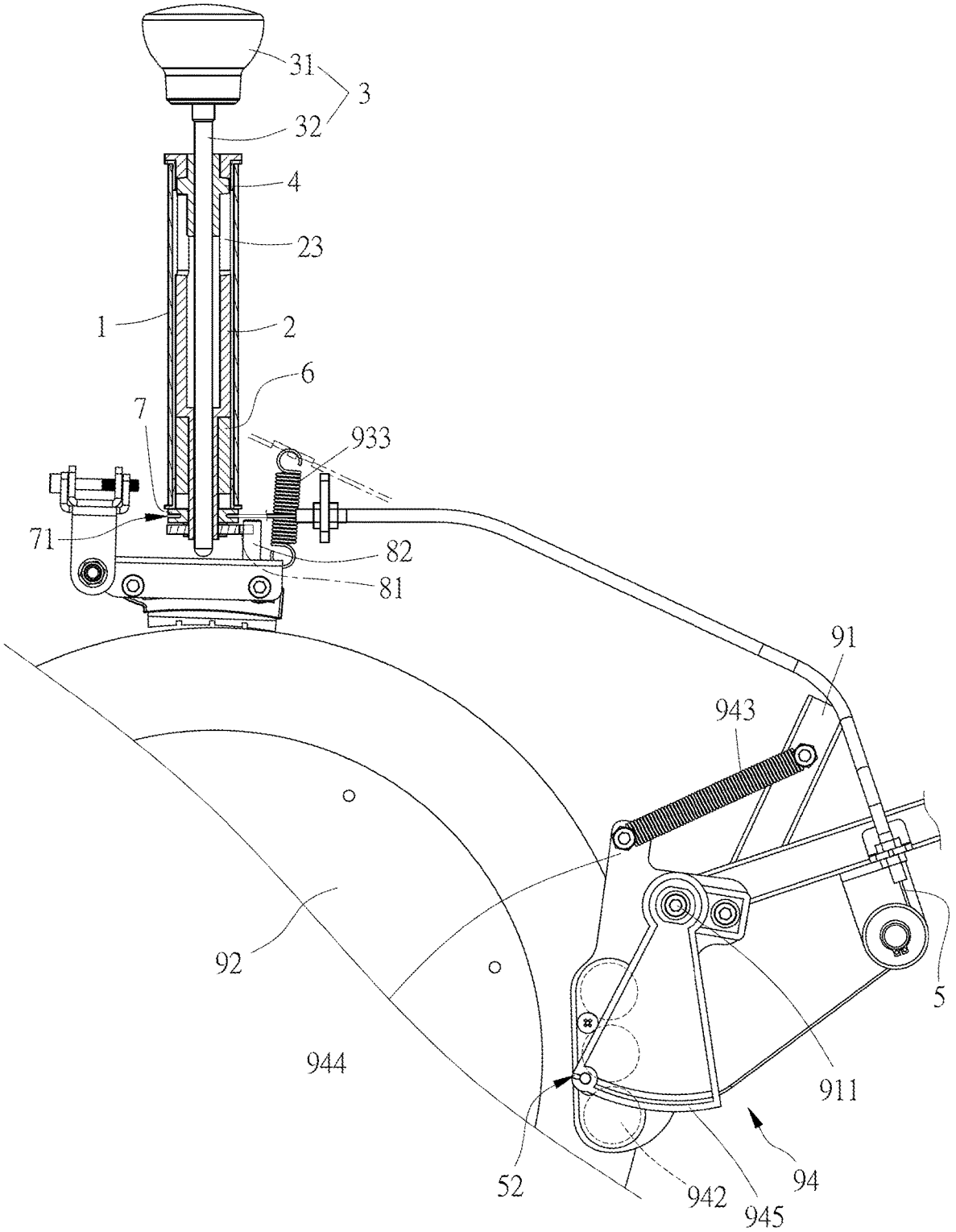
FIG. 14 is a schematic view showing the operation of the magnetic resistance unit of the present invention.

Please refer to FIG. 12 and FIG. 14. As shown in FIG. 12, when the limit disk 8 is rotated counterclockwise, the cable 5 is released. Finally, the protruding block 81 of the limit disk 8 abuts against one side of the limit member 82. At this time, the magnetic resistance unit 94 is relatively close to the flywheel 92, having a greater magnetic resistance effect. Please refer to FIG. 7, FIG. 11 and FIG. 13. When the operating portion 31 is rotated clockwise, the limit disk 8 shown in FIG. 13 is rotated clockwise along the rotation path A. Finally, the protruding block 81 of the limit disk 8 abuts against the other side of the limit member 82. At this time, the cable reel 8 winds up the cable 5 in the cable groove 71, so that the open slot 946 (shown in FIG. 8) of the magnetic resistance unit 94 shown in FIG. 7 is moved away from the flywheel 92. At this time, the reluctance resistance is the smallest. The magnetic resistance unit 94 is rotated with the first pivot point 911 as the axis through the traction of the cable 5 and the force of the third spring 943. When the cable 5 is released, the third spring 943 pulls the magnetic resistance unit 94, so that the magnetic resistance unit 94 is relatively close to the flywheel 92. When the cable 5 is pulled and retracted, the third spring 943 is stretched, and the magnetic resistance unit 94 is relatively far away from the flywheel 92.

Figure 15:
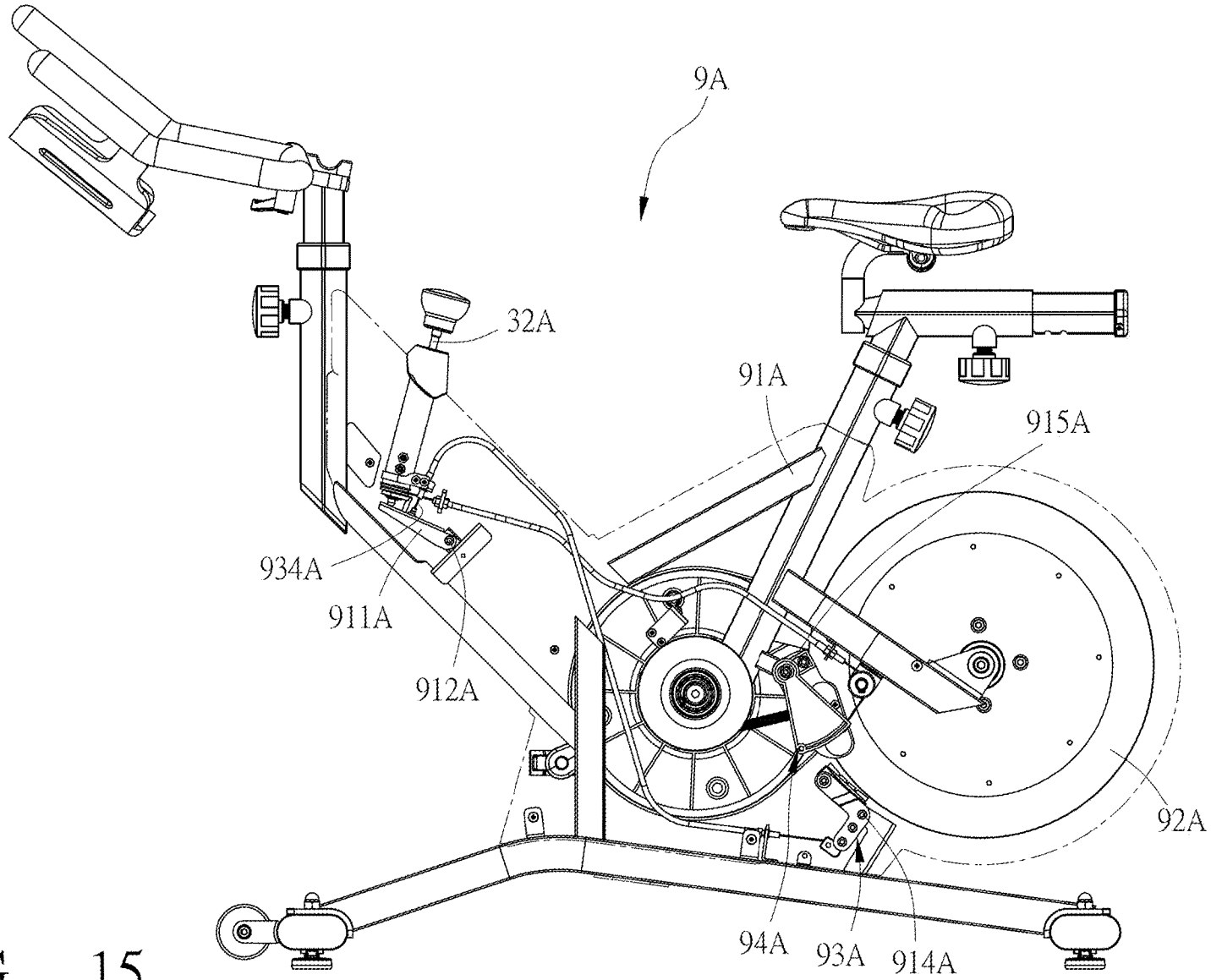
FIG. 15 is a schematic view of the exercise machine according to another embodiment of the present invention.
Figure 16:
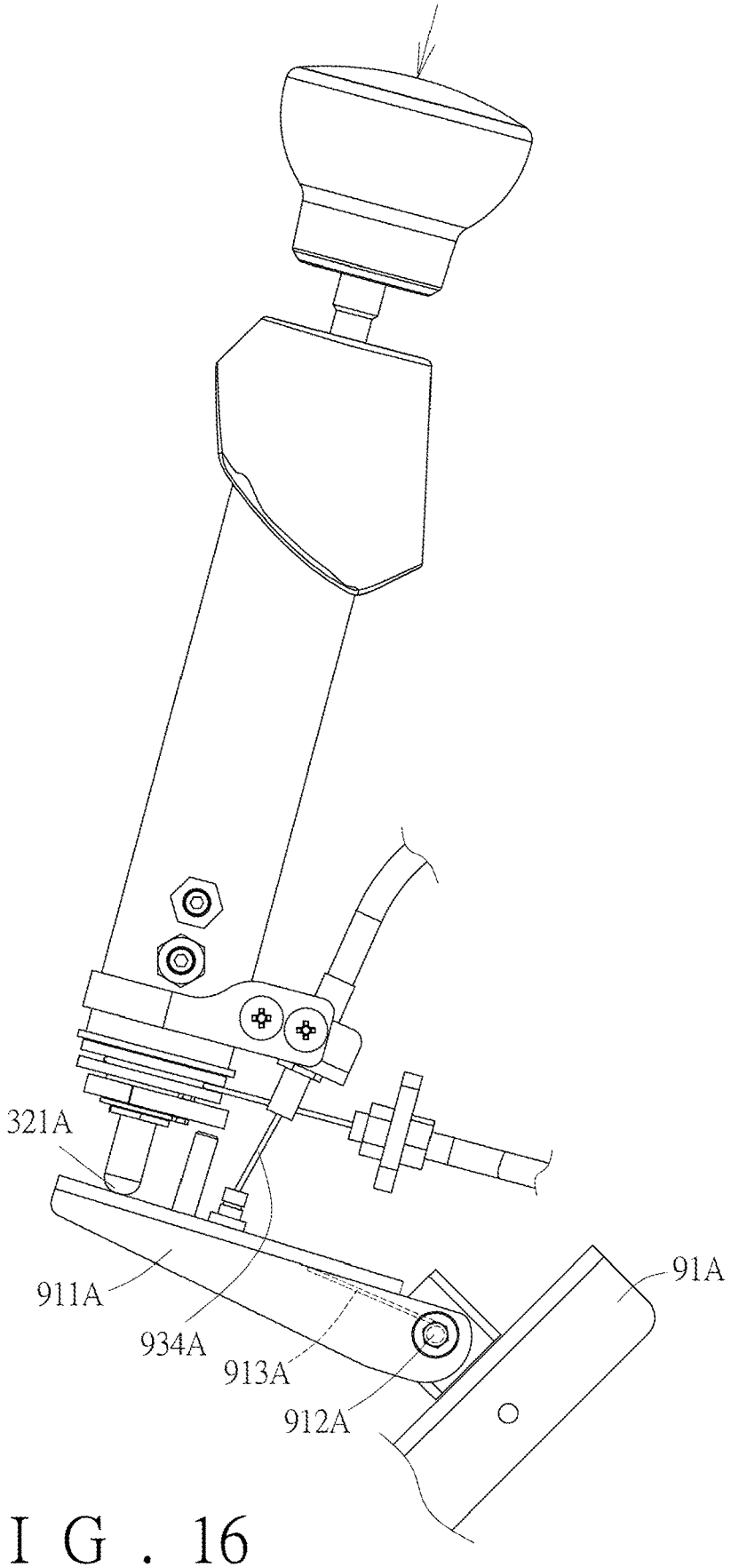
FIG. 16 is a schematic view of the magnetic resistance and brake control structure to control and operate the brake unit according to another embodiment of the present invention.
Figure 17:
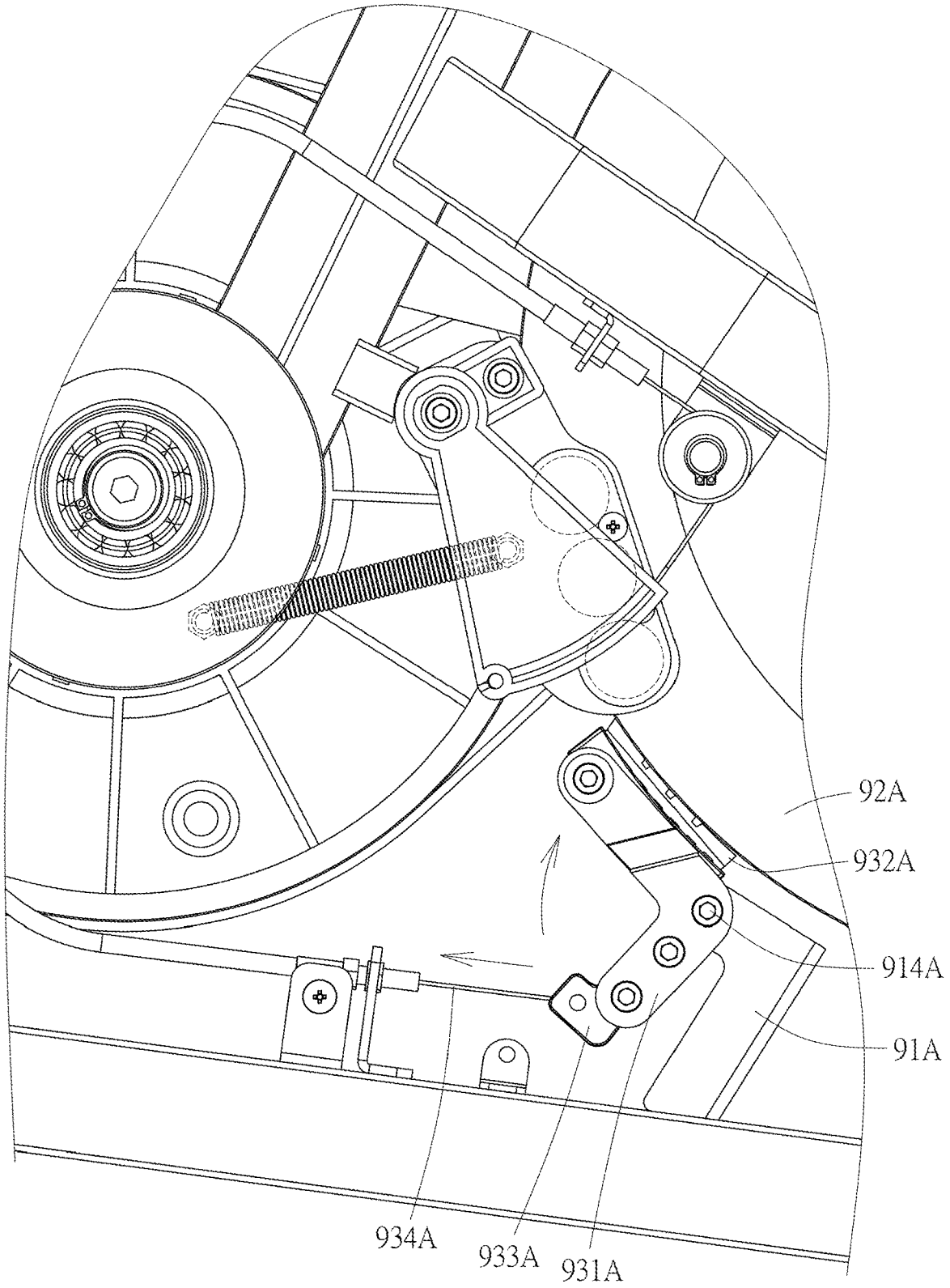
FIG. 17 is a schematic view showing the operation of the brake unit according to another embodiment of the present invention.

FIGS. 15-17 illustrate another embodiment of the present invention. The flywheel 92A of this embodiment is arranged at the rear of the exercise machine 9A. As shown in FIG. 16, a movable rod 911A is pivotally connected to the frame 91A of the exercise machine 9A via a second pivot point 912A. A torsion spring 913A is arranged at the second pivot point 912A to exert a return elastic force on the movable rod 911A. The movable rod 911A is connected to one end of a brake cable 934A. Please refer to FIG. 17. The other end of the brake cable 934A is connected to a brake seat 931A which is substantially L-shaped. The brake seat 931A is pivotally connected to the frame 91A through a third pivot point 914A. The brake seat 931A includes a friction block 932A and a connecting end 933A. The friction block 932A and the connecting end 933A are located on different sides of the third pivot point 914A, respectively. The friction block 932A faces the flywheel 92A. When the pressing end 321A presses down the movable rod 911A, the movable rod 911A will pull the brake cable 934A, and the brake cable 934A will pull the brake seat 931A. The brake seat 931A rotates clockwise with the third pivot point 914A as the axis, so that the friction block 932A is moved toward the flywheel 92A, thereby quickly braking or reducing the speed of the flywheel 92A. When the operating lever 32A releases the pressing end 321A, the movable rod 911A will be returned by the torsion spring 913A. The brake cable 934A releases the brake seat 931A. The brake seat 931A is rotated counterclockwise with the third pivot point 914A as the axis, so that the friction block 932A is moved in a direction away from the flywheel 92A, thereby releasing the brake on the flywheel 92A.

Figure 18:
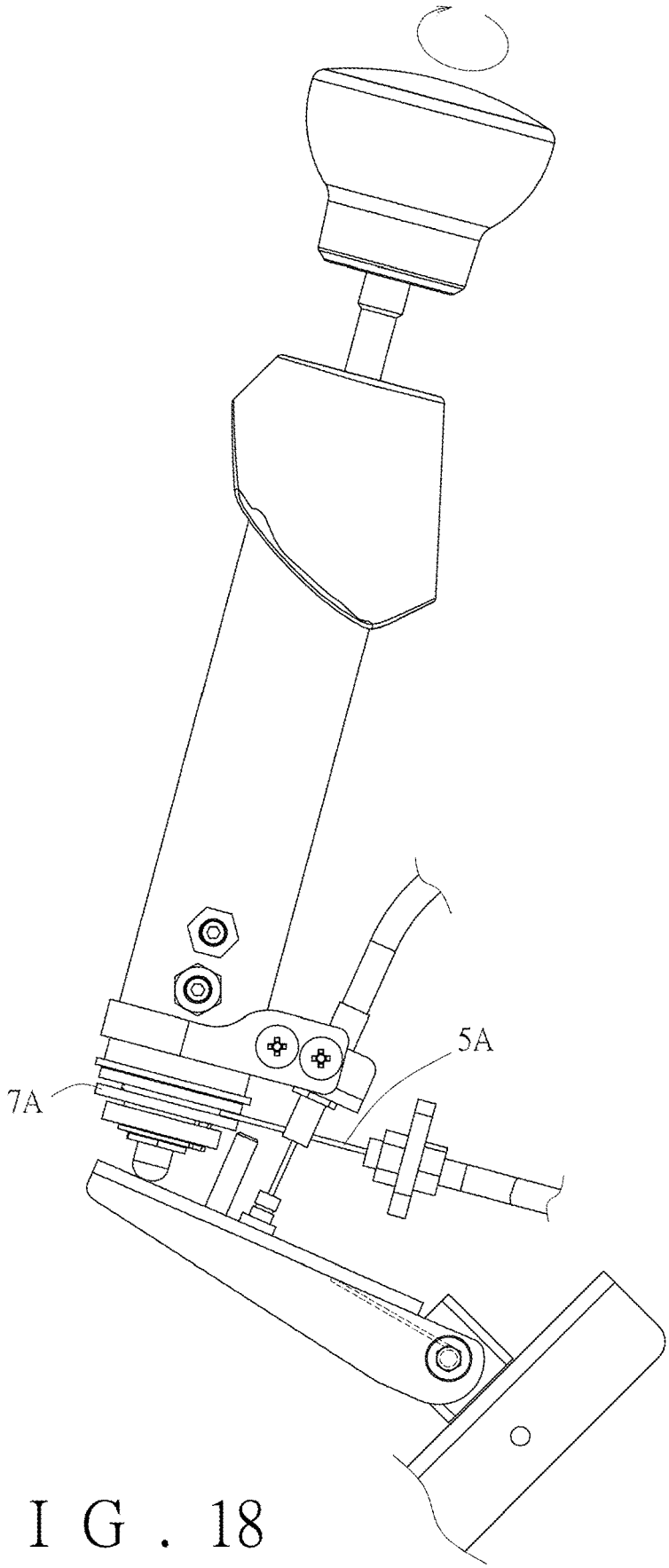
FIG. 18 is a schematic view of the magnetic resistance and brake control structure to control and operate the magnetic resistance unit according to another embodiment of the present invention.
Figure 19:
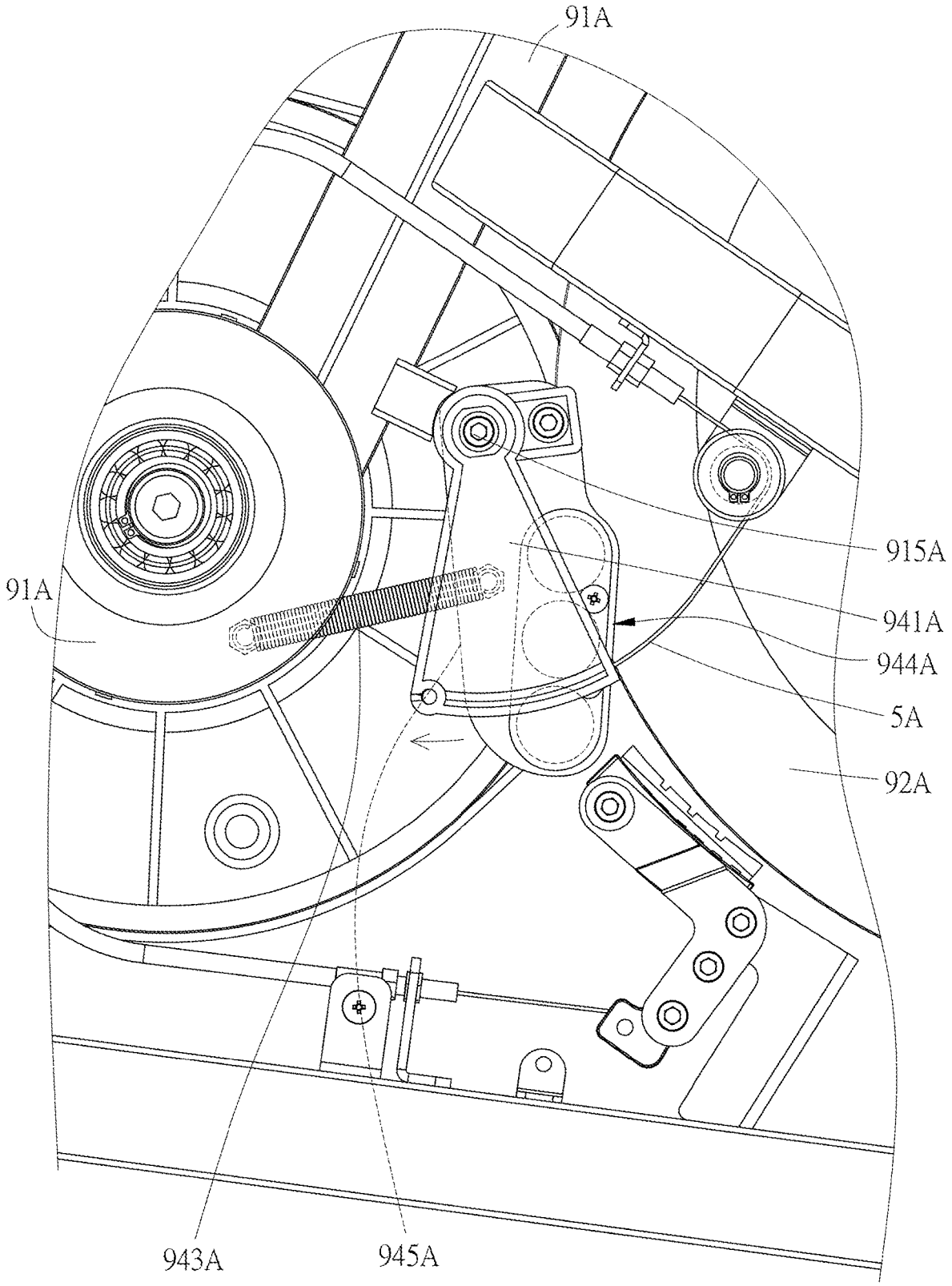
FIG. 19 is a schematic view showing the operation of the magnetic resistance unit according to another embodiment of the present invention.

Please refer to FIG. 15, FIG. 18 and FIG. 19. The cable reel 7A of this embodiment is connected to one end of a magnetic resistance cable 5A, and the other end of the magnetic resistance cable 5A is connected to a magnetic resistance seat 941A. The magnetic resistance seat 941A is pivotally connected to the frame 91A of the exercise machine 9A via a fourth pivot point 915A. The magnetic resistance seat 941A includes a first side 944A close to the flywheel 92A and a second side 945A opposite to the first side 944A. The magnetic resistance cable 5A is connected to the second side 945A. A fourth spring 943A is connected to the frame 91A and the second side 945A to exert a return elastic force on the magnetic resistance seat 941A. When the cable reel 7A rotates and pulls the magnetic resistance cable 5A, the magnetic resistance cable 5A pulls the magnetic resistance seat 941A from the second side 945A, so that the magnetic resistance seat 941A is rotated counterclockwise with the fourth pivot point 915A as the axis. The magnetic resistance seat 941A gradually approaches the flywheel 92A, so that the magnetic resistance of the flywheel 92A gradually increases. When the cable reel 7A rotates to release the magnetic resistance cable 5A, the fourth spring 943A will pull the magnetic resistance seat 941A, so that the magnetic resistance seat 941A is rotated clockwise with the fourth pivot point 915A as the axis. The magnetic resistance seat 941A is gradually moved away from the flywheel 92A, so that the magnetic resistance of the flywheel 92A gradually decreases.

The cable 5, the brake cable 934A and the magnetic resistance cable 5A of the foregoing embodiments are all inserted in a rigid pipe. The rigid pipe is fixed to the frame 91, 91A to ensure that the traction strokes of the cable 5, the brake cable 934A and the magnetic resistance cable 5A are maintained correctly.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A magnetic resistance and brake control structure, comprising:

a sleeve, having an operating end and an acting end;

a rotating member, coaxially disposed in the sleeve in an axial direction, the rotating member being rotatable relative to the sleeve, the rotating member having an axial guide groove extending in the axial direction, the rotating member including an exposed portion extending out of the acting end;

a compound operating member, including an operating portion and an operating lever, the operating portion being exposed at the operating end, the operating lever passing through the rotating member coaxially, the operating lever having a pressing end extending out of the exposed portion, the operating lever being movable relative to the rotating member in the axial direction;

a movable shaft, connected to the operating lever, the movable shaft being movable along the axial guide groove or driving the rotating member to rotate synchronously through the axial guide groove;

a cable, a first end of the cable being directly or indirectly fixed to the exposed portion;

wherein when the operating portion is rotated, the movable shaft drives the rotating member to rotate synchronously, so that the exposed portion pulls the cable to be retracted or released around the axial direction; when the operating portion is pressed, the operating lever is moved relative to the exposed portion in the axial direction.

2. The magnetic resistance and brake control structure as claimed in claim 1, wherein the rotating member further includes a body portion, one end of the body portion has a flange extending in a radial direction perpendicular to the axial direction, when the rotating member is disposed in the sleeve, the flange abuts against the operating end, another end of the body portion is connected to the exposed portion, a stepped face is formed between the body portion and the exposed portion, the rotating member has an axial hole passing through the body portion and the exposed portion in the axial direction, the axial guide groove is disposed on the body portion, and the operating lever passes through the axial hole.

3. The magnetic resistance and brake control structure as claimed in claim 2, wherein the movable shaft includes a shaft body and a protrusion, the shaft body has a through hole extending in the axial direction, the operating lever passes through the through hole, so that the shaft body is assembled in the axial hole, and the protrusion is slidable in the axial guide groove.

4. The magnetic resistance and brake control structure as claimed in claim 3, further comprising a positioning member, the positioning member being located in the sleeve, the positioning member abutting against the stepped face, the positioning member having a perforation extending in the axial direction, the exposed portion passing through the perforation to be fixed to the positioning member.

5. The magnetic resistance and brake control structure as claimed in claim 4, further comprising a cable reel, the cable reel having a cable groove formed on a periphery of the cable reel, the first end of the cable being connected to the cable reel, the cable being received in the cable groove, the cable reel being fixed to the exposed portion and abutting against the acting end of the sleeve, the rotating member being restricted by the cable reel and the positioning member so that the rotating member cannot move in the axial direction.

6. The magnetic resistance and brake control structure as claimed in claim 5, further comprising a limit disk fixed to the exposed portion, the limit disk including a protruding block extending in the radial direction, wherein when the rotating member is driven to rotate by the movable shaft, the cable reel and the limit disk are synchronously driven to rotate along a rotation path, the rotation path is provided with a limit member corresponding to the protruding block, and the limit member is configured to abut against the protruding block for limiting a rotation angle of the cable reel.

7. The magnetic resistance and brake control structure as claimed in claim 4, wherein an outer circumference of the positioning member is formed with a plurality of positioning grooves, a stop unit is connected to the sleeve, the stop unit includes an insert and a blocking member, the insert has a blind hole extending in the radial direction, a first spring is provided in the blind hole, the blocking member is disposed at an open end of the blind hole, the blocking member is moved back and forth in the radial direction, the first spring abuts against the blocking member, the blocking member is pressed against any one of the positioning grooves, so that the positioning member and the rotating member are positioned synchronously.

8. The magnetic resistance and brake control structure as claimed in claim 7, wherein the blocking member has a spherical surface configured to abut against any one of the positioning grooves.

9. An exercise machine comprising the magnetic resistance and brake control structure as claimed in claim 1, the exercise machine further comprising:

a frame;

a flywheel, rotatably connected to the frame;

a brake unit, pivotally connected to the frame, the brake unit being actuated by the pressing end to touch the flywheel for performing a brake or to move away from the flywheel for releasing the brake;

a magnetic resistance unit, pivotally connected to the frame, the magnetic resistance unit being connected to a second end of the cable, the magnetic resistance unit being controlled by the cable to move toward the flywheel or to move away from the flywheel, so as to control a magnetic resistance of the flywheel.

10. The exercise machine as claimed in claim 9, wherein the rotating member further includes a body portion, one end of the body portion has a flange extending in a radial direction perpendicular to the axial direction, when the rotating member is disposed in the sleeve, the flange abuts against the operating end, another end of the body portion is connected to the exposed portion, a stepped face is formed between the body portion and the exposed portion, the rotating member has an axial hole passing through the body portion and the exposed portion in the axial direction, the axial guide groove is disposed on the body portion, and the operating lever passes through the axial hole.

11. The exercise machine as claimed in claim 10, wherein the movable shaft includes a shaft body and a protrusion, the shaft body has a through hole extending in the axial direction, the operating lever passes through the through hole, so that the shaft body is assembled in the axial hole, and the protrusion is slidable in the axial guide groove.

12. The exercise machine as claimed in claim 11, further comprising a positioning member, the positioning member being located in the sleeve, the positioning member abutting against the stepped face, the positioning member having a perforation extending in the axial direction, the exposed portion passing through the perforation to be fixed to the positioning member.

13. The exercise machine as claimed in claim 12, wherein the magnetic resistance and brake control structure further comprises a cable reel, the cable reel has a cable groove formed on a periphery of the cable reel, the first end of the cable is connected to the cable reel, the cable is received in the cable groove, the cable reel is fixed to the exposed portion and abuts against the acting end of the sleeve, the rotating member is restricted by the cable reel and the positioning member so that the rotating member cannot move in the axial direction.

14. The exercise machine as claimed in claim 13, further comprising a limit disk fixed to the exposed portion, the limit disk including a protruding block extending in the radial direction, wherein when the rotating member is driven to rotate by the movable shaft, the cable reel and the limit disk are synchronously driven to rotate along a rotation path, the rotation path is provided with a limit member corresponding to the protruding block, and the limit member is configured to abut against the protruding block for limiting a rotation angle of the cable reel.

15. The exercise machine as claimed in claim 12, wherein an outer circumference of the positioning member is formed with a plurality of positioning grooves, a stop unit is connected to the sleeve, the stop unit includes an insert and a blocking member, the insert has a blind hole extending in the radial direction, a first spring is provided in the blind hole, the blocking member is disposed at an open end of the blind hole, the blocking member is moved back and forth in the radial direction, the first spring abuts against the blocking member, the blocking member is pressed against any one of the positioning grooves, so that the positioning member and the rotating member are positioned synchronously.

16. The exercise machine as claimed in claim 15, wherein the blocking member has a spherical surface configured to abut against any one of the positioning grooves.

17. The exercise machine as claimed in claim 9, wherein the brake unit includes a brake seat, a friction block and a second spring, the brake seat is pivotally connected to the frame, the friction block is fixed to the brake seat and faces the flywheel, one end of the second spring is connected to the frame, and another end of the second spring is connected to the brake seat to exert a return elastic force on the brake seat toward the pressing end.

18. The exercise machine as claimed in claim 9, wherein the magnetic resistance unit includes a magnetic resistance seat, at least one magnetic member and a third spring, the magnetic resistance seat is pivotally connected to the frame via a first pivot point, the magnetic resistance seat includes a first seat end and a second seat end, the first seat end and the second seat end are located on different sides of the first pivot point respectively, the magnetic member is fixed in the magnetic resistance seat, the magnetic resistance seat has an open slot, the magnetic member is disposed in the open slot, one end of the third spring is connected to the frame, another end of the third spring is connected to the first seat end, the second end of the cable is connected to the second seat end, and the cable controls the magnetic resistance seat to rotate about the first pivot point as an axis, so that the open slot is moved toward the flywheel or away from the flywheel.

* * * * *